US009320937B2

(12) United States Patent
Thompson

(10) Patent No.: US 9,320,937 B2
(45) Date of Patent: Apr. 26, 2016

(54) FITNESS EQUIPMENT UNIT

(71) Applicant: Precor Incorporated, Woodinville, WA (US)

(72) Inventor: Gregory A. Thompson, Island Lake, IL (US)

(73) Assignee: Precor Incorporated, Woodinville, WA (US)

( * ) Notice: Subject to any disclaimer, the term of this patent is extended or adjusted under 35 U.S.C. 154(b) by 230 days.

(21) Appl. No.: 13/891,402

(22) Filed: May 10, 2013

(65) Prior Publication Data

US 2014/0336018 A1 Nov. 13, 2014

(51) Int. Cl.

| | |
|---|---|
| ***A63B 21/062*** | (2006.01) |
| ***A63B 21/005*** | (2006.01) |
| ***A63B 21/00*** | (2006.01) |
| ***A63B 23/04*** | (2006.01) |
| *A63B 21/008* | (2006.01) |
| *A63B 22/00* | (2006.01) |

(52) U.S. Cl.

CPC ..... *A63B 21/062* (2013.01); *A63B 21/0051* (2013.01); *A63B 21/0052* (2013.01); *A63B 21/00069* (2013.01); *A63B 21/0628* (2015.10); *A63B 21/153* (2013.01); *A63B 21/155* (2013.01); *A63B 23/0405* (2013.01); *A63B 21/0083* (2013.01); *A63B 21/0087* (2013.01); *A63B 2022/0079* (2013.01)

(58) Field of Classification Search

CPC ..... A63B 21/00003; A63B 21/00007; A63B 21/00018; A63B 21/062; A63B 21/154; A63B 21/155; A63B 2021/0626; A63B 2021/0623; A63B 21/15; A63B 21/151; A63B 21/153; A63B 21/156; A63B 21/1465; A63B 21/1469; A63B 21/148; A63B 21/1492; A63B 21/1496; A63B 2225/10; A63B 2225/102; A63B 2225/105; A63B 2225/107

USPC ..... 482/92–94, 97–103, 115, 118–120, 482/133–138

See application file for complete search history.

(56) References Cited

U.S. PATENT DOCUMENTS

| | | | | | |
|---|---|---|---|---|---|
| 4,610,449 | A * | 9/1986 | Diercks, Jr. | ..... | 482/98 |
| 4,809,972 | A | 3/1989 | Rasmussen et al. | ..... | 272/118 |
| 5,417,633 | A | 5/1995 | Habing | ..... | 482/97 |
| 5,468,202 | A | 11/1995 | Habing | ..... | 482/100 |
| 5,597,257 | A | 1/1997 | Habing | ..... | 482/100 |
| 5,653,669 | A * | 8/1997 | Cheng | ..... | 482/138 |
| 5,667,465 | A * | 9/1997 | McCollum et al. | ..... | 482/100 |
| 5,803,882 | A | 9/1998 | Habing et al. | ..... | 482/136 |
| 5,885,193 | A | 3/1999 | Habing et al. | ..... | 482/92 |
| 5,967,954 | A | 10/1999 | Habing | ..... | 482/137 |
| 5,971,895 | A | 10/1999 | Habing | ..... | 482/100 |
| 5,997,447 | A * | 12/1999 | Giannelli | ..... | A63B 21/062 482/100 |
| 6,080,091 | A | 6/2000 | Habing et al. | ..... | 482/137 |
| 6,921,356 | B1 | 7/2005 | Habing et al. | ..... | 482/100 |
| 7,029,427 | B2 * | 4/2006 | Vuurmans | ..... | A63B 23/1245 482/100 |
| 7,524,272 | B2 * | 4/2009 | Bruck | ..... | A63B 21/153 482/126 |

(Continued)

*Primary Examiner* — Loan H Thanh
*Assistant Examiner* — Gregory Winter
(74) *Attorney, Agent, or Firm* — Terence P. O'Brien; Todd A. Rathe

(57) ABSTRACT

A fitness equipment unit includes a member rotatable about an axis and a source of resistance against rotation of the member. Rotation of the member is facilitated by pulling on a first end of the line while the other end of the line is stationary, pulling on a second end of the line while the first end is stationary or concurrently pulling on both the first end and the second end of the line.

24 Claims, 9 Drawing Sheets

(56) References Cited

U.S. PATENT DOCUMENTS

| | | | | |
|---|---|---|---|---|
| 7,645,216 | B2 * | 1/2010 | Edeker | 482/92 |
| 7,695,414 | B2 * | 4/2010 | Tiahrt | 482/133 |
| 7,740,568 | B2 * | 6/2010 | Webb | A63B 21/0455 482/94 |
| 7,922,629 | B1 * | 4/2011 | Batca | 482/94 |
| 7,938,761 | B2 * | 5/2011 | Simonson | A63B 21/0615 482/100 |
| 8,057,368 | B1 * | 11/2011 | Lyszczarz | 482/103 |
| 2005/0250626 | A1 * | 11/2005 | Charnitski | 482/92 |
| 2007/0135272 | A1 * | 6/2007 | Stuckey | 482/98 |
| 2010/0144500 | A1 * | 6/2010 | Canali | 482/137 |
| 2011/0275497 | A1 * | 11/2011 | Lorusso | 482/139 |
| 2011/0294628 | A1 * | 12/2011 | Nishimura | 482/102 |

* cited by examiner

FITNESS EQUIPMENT UNIT

BACKGROUND

Fitness equipment units or exercise machines frequently involve the movement of two arms concurrently or independently against a resistance. Such fitness equipment units may employ a floating pulley or split cable. The floating pulley or split cable is difficult to employ while also maintaining compactness of the fitness equipment unit.

BRIEF DESCRIPTION OF THE DRAWINGS

FIG. 12 illustrating concurrent movement of arms and rotation of a rotary load splitting mechanism to lift a weight stack.

FIG. 13 illustrating unequal movement of arms and rotation of the rotary load splitting mechanism to lift the weight stack.

DETAILED DESCRIPTION OF THE EXAMPLE EMBODIMENTS

Figure 1:
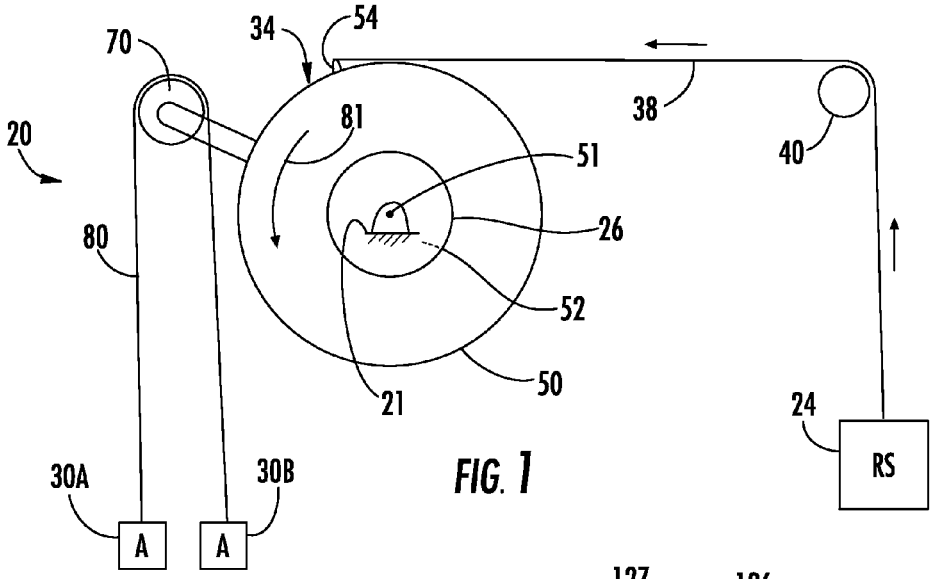
FIG. 1 is a schematic illustration of an example fitness equipment unit.

FIG. 1 schematically illustrates one example of a fitness equipment unit 20. Fitness equipment unit 20 comprises an exercise machine or exercise device by which a person interacts with a pair of arms to move the pair of arms independently or concurrently against exercising works against a resistance. As will be described hereafter, fitness equipment unit 20 comprises a rotary load splitting mechanism that facilitates independent movement of such arms or concurrent movement of such arms. As will be described hereafter, the rotary load splitting mechanism is compact, increasing design flexibility.

Fitness equipment unit 20 comprises resistance sources 24, 26, arms 30A, 30B (collectively referred to as arms 30), and rotary load splitting mechanism 34. Resistance sources 24, 26 comprise devices or mechanisms operably coupled to arms 30 by rotary load splitting mechanism 34 so as to oppose or resist movement of arms 30. In one implementation, resistance source 24 comprises one or more members operably coupled to a rotating portion of rotary load splitting mechanism 34 such that the one or more members are moved, compressed or stretched upon movement of one or both of arms 30, wherein gravity, friction or the one or more member's resistance against a change in shape oppose movement of arms 30.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

In one implementation, resistance source 24 comprises a weight or a stack of weights operably coupled to rotary load splitting mechanism 34 by a line 38 which is guided by one or more guides 40, wherein rotation of rotary load splitting mechanism 34 raises and lowers resistance source 24 against gravity. Line 38 may comprise a cable, a belt, a chain or other flexible elongate members. Guide 40 comprises a stationary low friction track or channel or may comprise a roller or pulley.

In another implementation, resistance source 24 comprises a member operably coupled to rotary load splitting mechanism 34 such that the member resiliently changes shape in response to rotation of rotary load splitting mechanism 34 and movement of one or both of arms 30. For example, in one implementation, resistance source 24 may comprise a rubber or polymeric member operably coupled to arms 30 by rotary load splitting mechanism 34 such that the member resiliently stretches upon movement of arms 30. In another implementation, resistance source 24 may comprise a tension spring or a compression spring operably coupled to arms 30 by rotary load splitting mechanism 34. In some implementations, line 38 and guide 40 may connect resistance source 24 to rotary load splitting mechanism 34. In another implementation, resistance source 24 may be directly connected to rotary load splitting mechanism 34.

Resistance source 26 comprises one or more members or mechanisms that are not moved by rotation or movement of rotary load splitting mechanism 34, but which brake rotation of load splitting mechanism 34 to oppose rotation of the rotating member of rotary load spitting mechanism 34 and movement of one or both of arms 30. In one implementation, resistance source 26 may comprise a mechanical friction brake which frictionally interacts with a rotating surface of rotary load splitting mechanism 34 to oppose movement of arms 30. In another implementation, resistance source 26 may comprise a magnetic brake or an electrical brake, such as an Eddy current brake, which opposes rotation of a rotatable surface of the rotary load splitting mechanism 34 to oppose movement of one or both of arms 30. In another implementation, the source 24 may comprise an air brake or other forms of brakes that directly interact with rotary load splitting mechanism 34.

In some implementations, the resistance provided by one or both of resistance sources 24, 26 against movement of arms 30 is adjustable. For example, in implementations where resistance source 24 comprises a stack of weights, the resistance is adjustable by adjusting the number of weights of the stack or which weights of the stack or operably connected to arms 30 by rotary load splitting mechanism 34. In implementations where resistance source 24 comprises one or more resilient members that are resiliently stretched or compressed, the degree of resistance may be adjusted by adjusting resistance characteristic of the one or more resilient members that are operably coupled to arms 30 by rotary load splitting mechanism 34. In implementations where resistance source 26 comprises a friction brake, the degree of resistance may be adjusted by adjusting the force at which the frictional brakes are pressed against the opposing rotating surface of rotary load splitting mechanism 34. In implementations where resistance source 26 comprises an Eddy current brake, the degree of resistance may be adjusted by adjusting the proximity of the Eddy current brake to the rotating surface of rotary load splitting mechanism 34. Such adjustments may be achieved by using mechanical actuator such as electric solenoids, hydraulic or pneumatic cylinder-piston assemblies or the like which move the one or more braking members relative to the rotating surface of rotary load splitting mechanism 34. In some implementations, fitness equivalent unit 20 omits one of resistance sources 24, 26, utilizing either resistance source 24 or resistance source 26.

Arms 30 comprise members by which a person interacts with and moves against any resistance provided by resistance sources 24, 26. In one implementation, arms 30 comprise pivotable members. In one implementation, arms 30 are pivotable about a horizontal axis such as in a rowing machine, curling machine, leg extension machines, lat machine or bench press machine. In another implementation, arms 30 are pivotable about a vertical or inclined axis, such as in a pec machine. In another implementation, arms 30 comprise linearly movable members that are guided along linear paths with tracks or the like. In one implementation, arms 30 are located so as to be interacted upon by a person's feet. In another implementation, arms 30 are located so as to be interacted upon by a person's arms or manually gripped.

Rotary load splitting mechanism 34 operably couples resistance source 24, 26 to arms 30. Rotary load splitting mechanism 34 comprises rotating member 50, guide 70 and line 80. Rotating member 50 comprises a member rotationally supported by a frame 21 for rotation about an axis 51. Rotating member 50 comprises a rotating surface 52 which interacts with the braking member of resistance source 26. Rotating member 50 further comprises an eccentric connection location 54 which is connected to resistance source 24 either directly or indirectly by line 38. Although rotating member 50 is schematically illustrated as comprising a circular disk, cylinder or circular plate, in other implementations, rotating member 50 may have other shapes such as a bar, a crescent and the like. Rotating member 50 carries and supports guide 70 eccentrically with respect to axis 51.

Guide 70 comprises a member eccentrically carried by rotating member 50 to guide movement of line 80. Guide 70 is configured to facilitate movement of line 80 relative to and across or about guide 70. In one implementation, guide 70 comprises a structure that is stationary but for movement of guide 70 as a result of guide 70 being carried by rotating member 50, wherein guide 70 comprises a bearing surface against which line 80 slides. In such an implementation, the bearing surface may comprise a low friction surface or may be bound or defined in a track, groove or channel. In another implementation, guide 70 may itself rotate about its own axis as line 80 travels across and about guide 70. In one implementation, guide 70 comprises a pulley. In another implementation, guide 70 comprises a toothed sprocket. In one implementation, guide 70 may rotate about its own axis, wherein the axis of guide 70 extends parallel to axis 51. In another implementation, guide 70 may rotate about its own axis, wherein the axis of guide 70 extends perpendicular to axis 51.

Line 80 comprises an elongate flexible member having a first portion connected to arm 30A and a second portion connected to arm 30B. Line 80 extends about guide 70. In one implementation, line 80 comprises a cable. In another implementation, line 80 comprises a belt. In yet another implementation, line 80 comprises a chain. Although illustrated as merely extending about guide 70, in other implementations, line 80 may additionally extend against or about one or more additional guiding surfaces or guiding structures such as tracks, pulleys, sprockets and the like.

In operation, rotating member 50, guide 70 and line 80 cooperate to operably couple aims 30 to resistance sources 24, 26 such that arms 30 may be independently or concurrently moved against the forces of resistance sources 24, 26. During concurrent and equal movement of arms 30, line 80 pulls on guide 70 to rotate rotatable member 50 about axis 51 in the direction indicated by arrow 81 against the resistance offered by one or both of resistance sources 24, 26. During unequal movement of arms 30, such as where one of arms 30 is moved a greater distance as compared to the other of arms 30 or such as where one arm 30 is stationary while the other of arms 30 is moved, line 80 moves across or about guide 70 as rotatable member 50 is rotated against any resistance offered by one or both of resistance sources 24, 26.

Figure 2:
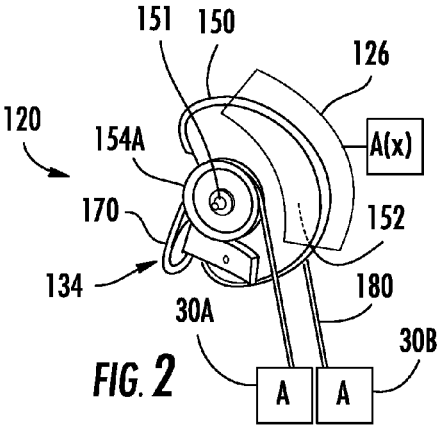
FIG. 2 is a side perspective view of an example implementation of the fitness equipment unit of FIG. 1.
Figure 3:
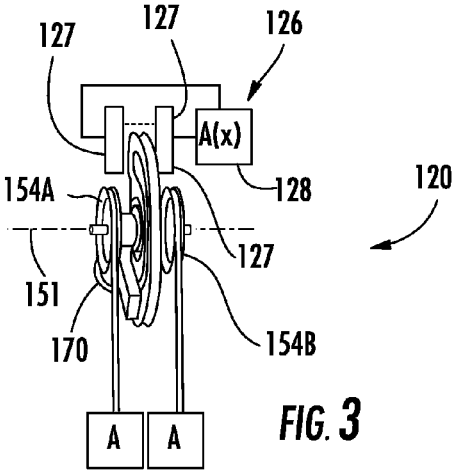
FIG. 3 is a rear perspective view of the fitness equipment unit of FIG. 2.

FIGS. 2 and 3 illustrate fitness equipment unit 120, an example implementation of fitness equipment unit 20. Fitness equipment unit 120 comprises resistance source 126, arms 30 and rotary load splitting mechanism 134. Resistance source 126 comprises one or more members or mechanisms that are not moved by rotation or movement of rotary load splitting mechanism 34, but which brake rotation of rotary load splitting mechanism 134 to oppose rotation of the rotating surface of rotary load spitting mechanism 134 and movement of one or both of arms 30.

In the example illustrated, resistance source 126 comprises a pair of opposing braking plates 127 and actuator 128. Braking plates 127 comprise plates are members positioning is opposite sides or opposite rotating surfaces of rotary load splitting mechanism 134. In one implementation in which resistance source 126 comprises a mechanical friction brake, plates 127 frictionally interact with a rotating surface of rotary load splitting mechanism 134 to oppose movement of arms 30. In another implementation in which resistance source 126 comprises a magnetic or electrical brake, such as an Eddy current brake, plates 127 comprise ferromagnetic plates that are magnetic or that are made magnetic so as to generate any current opposing rotation of a rotatable surface of the rotary load splitting mechanism 134 to oppose movement of one or both of arms 30.

Actuator 128 comprises a mechanism to adjust the resistance provided by resistance source 126 against movement of arms 30. In implementations where resistance source 126 comprises a friction brake, actuator 128 adjust the degree of resistance by adjusting the force at which the frictional braking plates 127 are pressed against the opposing rotating surface of rotary load splitting mechanism 134. In implementations where resistance source 126 comprises an Eddy current brake, actuator 128 adjusts the degree of resistance by adjusting the proximity of the Eddy current brake to the rotating surface of rotary load splitting mechanism 34 or by adjusting a magnetic strength of such plates 127. In one implementation, actuator 128 comprises a mechanical actuator such as an electric solenoid, hydraulic or pneumatic cylinder-piston assembly or the like which move the one or more braking plates 127 relative to the rotating surface of rotary load splitting mechanism 134. Arms 30 are described above with respect to FIG. 1 and fitness equipment unit 20.

Rotary load splitting mechanism 134 operably couples resistance source 126 to arms 30. Rotary load splitting mechanism 134 comprises rotating member 150, side guides 154A, 154B (collectively referred to as guides 154), guide 170 and line 180. Rotating member 150 comprises a member rotationally supported by a frame for rotation about an axis 151. Rotating member 150 comprises a rotating surface 152 which interacts with the braking plates 127 of resistance source 126. In the example illustrated, rotating member 150 crescent-shaped, allowing guide 170 to be located in close proximity to axis 151, decreasing a length of line 180 and increasing a compactness of rotary load splitting mechanism 134. In other implementations, rotating member 150 may have other shapes such as a bar or a circular or oval-shaped plate or pulley. Rotating member 150 carries and supports guide 170 eccentrically with respect to axis 151.

Guides 154 guide and direct movement of line 180 from one side of rotating member 150, about guide 170, to the other side of rotating member 150. Guides 154 facilitate connection of lines 182 spaced apart arms 30. Guides 154 are located relative to guide 170 such that pulling upon either end of line 180 by arms 30 applies a torque to rotating member 150 to rotate rotating member 150 about axis 151. In the example illustrated, guides 154 support line 180 such that line 180, when pulled, pulls upward on guide 170 to rotate guide 170 (and the attached rotating member 150) in a clockwise direction about axis 151 as seen in FIG. 2. In other implementations, guides 154 may provide guiding surfaces at other relative locations with respect to guide 170, such as below guide 170.

In the example illustrated, guides 154 comprise pulleys that rotate about the same axis 151 as rotating member 150 rotates. In other implementations, guides 154 rotate about axes that are distinct from or offset from axis 151. Guides 154 rotate independently of rotating member 150. In another implementation, guides 154 may comprise toothed sprockets. In yet other implementations, guides 154 may comprise a stationary line guiding surfaces, such as grooves, along which lines 180 slide or travel.

Guide 170 comprises a member eccentrically carried by rotating member 150 to guide movement of line 180. Guide 170 is configured to facilitate movement of line 180 relative to (with respect to) and across or about guide 170. In the example illustrated, guide 170 rotates about its own axis as line 180 travels across and about guide 170. In the illustrated example, guide 170 comprises a pulley which rotates about an axis perpendicular to axis 151. Because guide 170 rotates about an axis perpendicular to axis 151 (axis 151 extends sideways while guide 170 rotates about a forwardly extending axis), the flat face of guide 170 is positioned closer to rotating member 150 and axis 151 so as to project a shorter distance in front of axis 151, increasing a compactness of rotary load splitting mechanism 134 and reducing a length of line 180. In other implementations, in lieu of comprising a pulley, guide 170 may comprise a tooth sprocket, such as where line 180 comprises a tooth belt or chain.

In other implementations, guide 170 comprises a structure that is stationary but for movement of guide 170 as a result of guide 170 being carried by rotating member 150, wherein guide 170 comprises a bearing surface against which line 180 slides. In such an implementation, the bearing surface may comprise a low friction surface or may be bound or defined in a track, groove or channel. In another implementation, guide 170 may rotate about its own axis, wherein the axis of guide 70 extends parallel to axis 151.

Line 180 comprises an elongate flexible member having a first portion connected to arm 30A and a second portion connected to arm 30B. Line 180 extends over each of guides 154 and about an underside of guide 170. In other implementations, line 180 alternatively extends beneath guides 154 and over a top side of guide 170, wherein pulling of line 180 rotates rotating member 150 in a counterclockwise direction about axis 151 as seen in FIG. 2.

In one implementation, line 180 comprises a cable. In another implementation, line 180 comprises a belt. In yet another implementation, line 180 comprises a chain Although illustrated as merely extending about guides 154 and guide 170, in other implementations, line 180 may additionally extend against or about one or more additional guiding surfaces or guiding structures such as tracks, pulleys, sprockets and the like.

In operation, rotating member 150, guides 154, guide 170 and line 180 cooperate to operably couple arms 30 to resistance source of 126 such that arms 30 may be independently or concurrently moved against the forces of resistance source 126. During concurrent and equal movement of arms 30, line 180 pulls on guide 170 to rotate rotatable member 150 about axis 151 in a clockwise direction as seen in FIG. 2 against the resistance offered by resistance source 126. During unequal movement of arms 130, such as where one of arms 30 is moved a greater distance as compared to the other of arms 30 or such as where one arm 30 is stationary while the other of arms 30 is moved, line 180 moves across or about guide 170 as rotatable member 150 is rotated against any resistance offered by resistance source 126.

Figure 4:
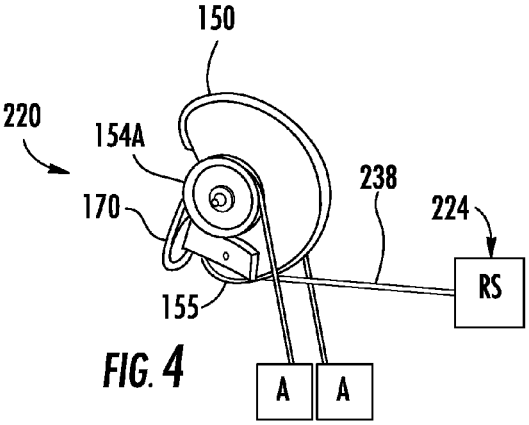
FIG. 4 is a side perspective view of an example implementation of the fitness equipment unit of FIG. 1.
Figure 5:
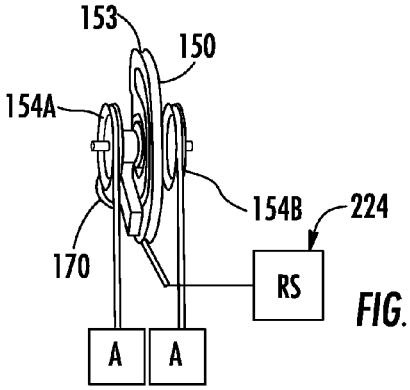
FIG. 5 is a rear perspective view of the fitness equipment unit of FIG. 4.

FIGS. 4 and 5 illustrate fitness equipment unit 220, another example implementation of fitness equipment unit 20. Fitness equipment unit 220 is similar to fitness equipment unit 120 described above except that fitness equipment unit 220 comprises resistance source 224 in lieu of resistance source 126. Those remaining components of fitness equipment unit 220 which correspond to components of fitness equipment unit 120 are numbered similarly.

Resistance source 224 comprises one or more members operably coupled to a rotating portion of rotary load splitting mechanism 134 such that the one or more members are moved, compressed or stretched upon movement of one or both of arms 30, wherein gravity, friction or the one or more member's resistance against a change in shape oppose movement of arms 30. In one implementation, resistance source 224 comprises a weight or a stack of weights operably coupled to rotary load splitting mechanism 34 by a line 238 eccentrically attached to an underside of rotating member 150, wherein rotation rotating member 150 raises and lowers resistance source 224 against gravity. Line 238 may comprise a cable, a belt, a chain or other flexible elongate members.

As noted above with respect to fitness equipment unit 120, rotating member 150 is crescent-shaped, allowing guide 170 to be located in close proximity to axis 151, decreasing a length of line 180 and increasing a compactness of rotary load splitting mechanism 134. At the same time, the crescent shape of rotating member 150 provides an arcuate surface against and about which line 238 may smoothly wrap as rotating member 150 is rotated in a clockwise direction as seen in FIG. 4. In the example illustrated, rotating member 150 comprises a crescent-shape pulley having a circumferential groove 153 to receive line 138 as line 138 wraps about the arcuate side of rotating member 150, further increasing the compactness and reliability of fitness equipment unit 220.

In other implementations, resistance source 224 comprises a member operably coupled to rotary load splitting mechanism 134 such that the member resiliently changes shape in response to rotation of rotary load splitting mechanism 134 and movement of one or both of arms 30. For example, in one implementation, resistance source 224 may comprise a rubber or polymeric member operably coupled to arms 30 by rotary load splitting mechanism 134 such that the member resiliently stretches upon movement of arms 30. In another implementation, resistance source 224 may comprise a tension spring or a compression spring operably coupled to arms 30 by rotary load splitting mechanism 134. Although line 238 is illustrated as directly connecting resistance source 224 to rotary load splitting mechanism 134, in other implementations, additional guides may be located between resistance source 224 and rotary load splitting mechanism 134 to guide movement of line 238. In other implementations, resistance source 224 may be directly connected to rotary load splitting mechanism 134, omitting line 138. In one implementation, line 138 may comprise the resistance source 224 such as where line 138 is a resiliently stretchable.

FIGS. 6-13 illustrate fitness equipment unit 320, an example implementation of fitness equipment units 20, 220. Fitness equipment unit 320 comprises frame 321, seat 322, resistance source 324, arms 330A, 330B (collectively referred to as arms 330), manual grips 332A, 332B (collectively referred to as grips 332), rotary load splitting mechanism 134 (described above) and side guides 390A and 390B (shown in FIGS. 8 and 9) (collectively referred to as guides 390). Frame 321 comprises one or more foundational structures which support arms 330, rotary load splitting mechanism 134 and guides 390. In the example illustrated, frame 321 further support seat 322.

Seat 322 comprises a surface upon which a person exercising sits while exercising. In the example illustrated in which fitness query unit 320 comprises a rowing machine, seat 322 is relatively low to the underlying support surface or ground while his or her feet are positioned against footplate 333 of frame 321. Seat 322 is located such that a person may interact with arms 330 using grips 332. In other implementations, seat 322 may have other configurations, orientations and locations.

Figure 9:
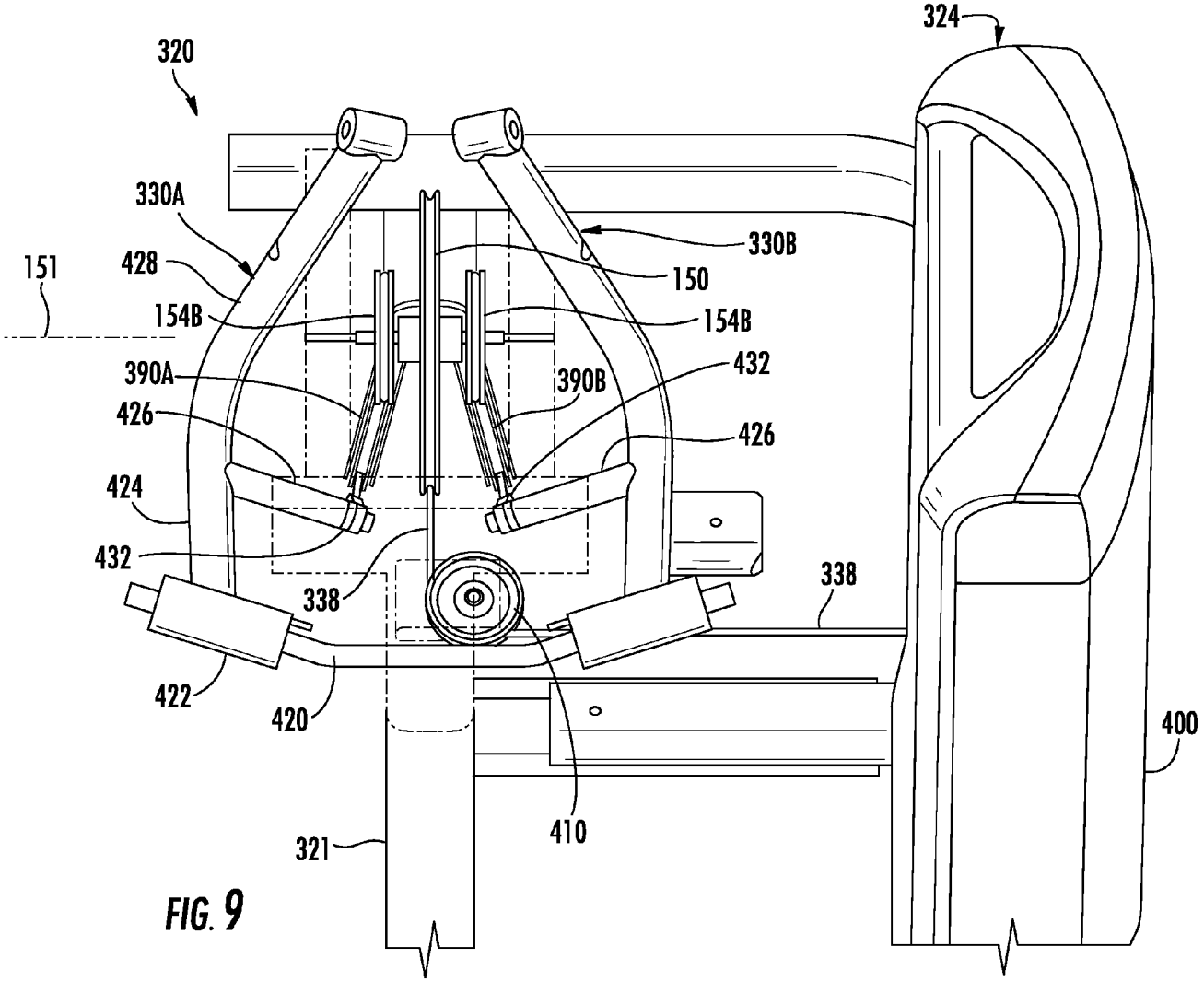
FIG. 9 is another rear perspective view of the fitness equipment unit of FIG. 6 with some portions omitted and some portions shown as transparent for purposes of illustration.
Figure 10:
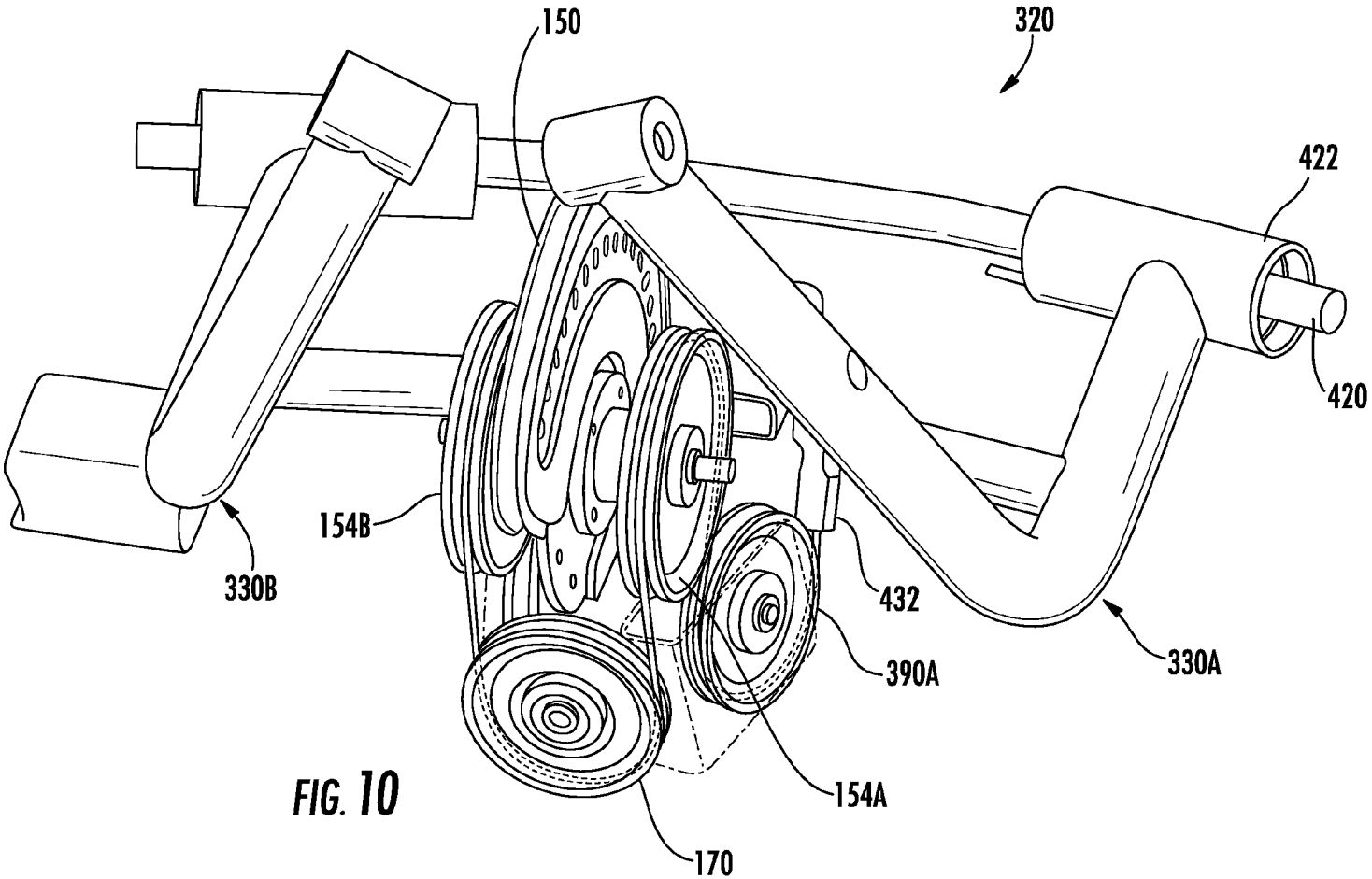
FIG. 10 is a front perspective view of the fitness equipment unit of FIG. 6 with some portions omitted and some portions shown as transparent for purposes of illustration.
Figure 11:
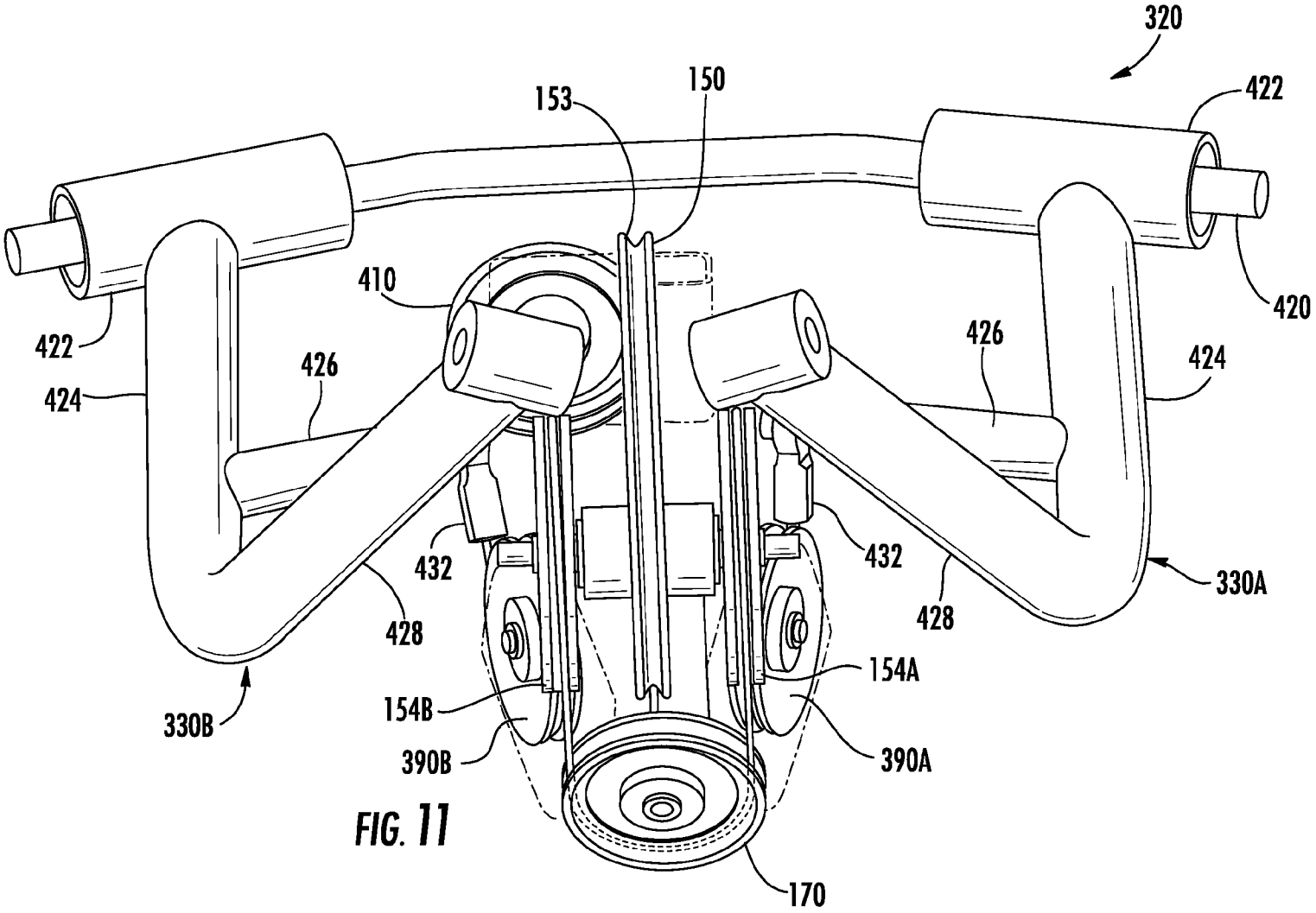
FIG. 11 is another front perspective view of the fitness equipment unit of FIG. 6 with some portions omitted and some portions shown as transparent for purposes of illustration.

Resistance source 324 comprises a source of resistance that is operably coupled to arms 330 (and grips 332) by rotary load splitting mechanism 134. In the example illustrated, resistance source 324 comprises a stack of weights that are lifted in response to pulling of grips 332 and pivotal movement of arms 330. Resistance source 324 comprises weight rack 400, stack 402 of individual weights 404, lift rod 406 and pin 408. Weight rack 400 comprises an outer housing or frame supporting, enclosing and guiding movement of the stack 402 of weights 404. In the example illustrated, weight rack 400 further supports one or more guides, such as one or more pulleys (which may be contained within the interior of rack 400) that direct movement of a line 338 interconnecting lift rod 406 of resistance source 324 to rotary load splitting mechanism 134. As shown by FIG. 9, frame 321 also supports a guide 410 (shown as a pulley) which redirects the direction of line 338 to rotating member 150 of rotary load splitting mechanism 134. In the example illustrated, line 338 comprises a cable extending from above stack 402, laterally to a side of stack 402, to a bottom of rack 400, exterior of rack 400, about guide 410, to an eccentric mounting point 155 on a bottom side of rotatable member 150.

Individual weights 404 which form stack 402 each include an opening 414 that is in alignment with a corresponding opening within lift rod 406 when the stack 402 is at rest. Openings 414 and the openings within lift rod 406, when aligned, receive a pin 408, operably connecting the individual weight 404 to lift rod 406 (and all overlying weights 404) such that lifting of lift rod 406 upon pulling of line 338 also lifts the selected weight 404 and all of the overlying weights 404. By selectively positioning pin 408 in an opening 414 of one of the weights 404, a person may adjust the resistance offered by resistance source 324. In other implementations, other mechanisms may be utilized to selectively couple one or more of weights 404 to lift rod 406.

Arms 330 comprise members by which a person interacts with and moves against any resistance provided by resistance source 324. As shown by each of FIGS. 8-10, arms 330 comprise L-shaped members which independently rotate about one or more axes provided by pitted rod 420 which is supported by frame 321. Each of arms 330 has a sleeve or hub for 22 rotatably supported about pivot rod 420, a lower forward projecting portion 424 from which a line mounting post 426 projects and a forward upwardly extending portion 428, and end of which is secured to one of grips 332 (shown in FIGS. 6 and 7). Line mounting post 426 extends from the associated one of arms 330 and rotationally supports a line connector 432 which is secured to line 180. Line connector 432 pivots relative to post 426 and is configured to be attached to an end portion of line 180. In the example illustrated, arms 330 rotate about distinct axes which are oblique to one another. In other implementations, arms 330 may rotate about axes at other orientations or about a single axis.

Figure 6:
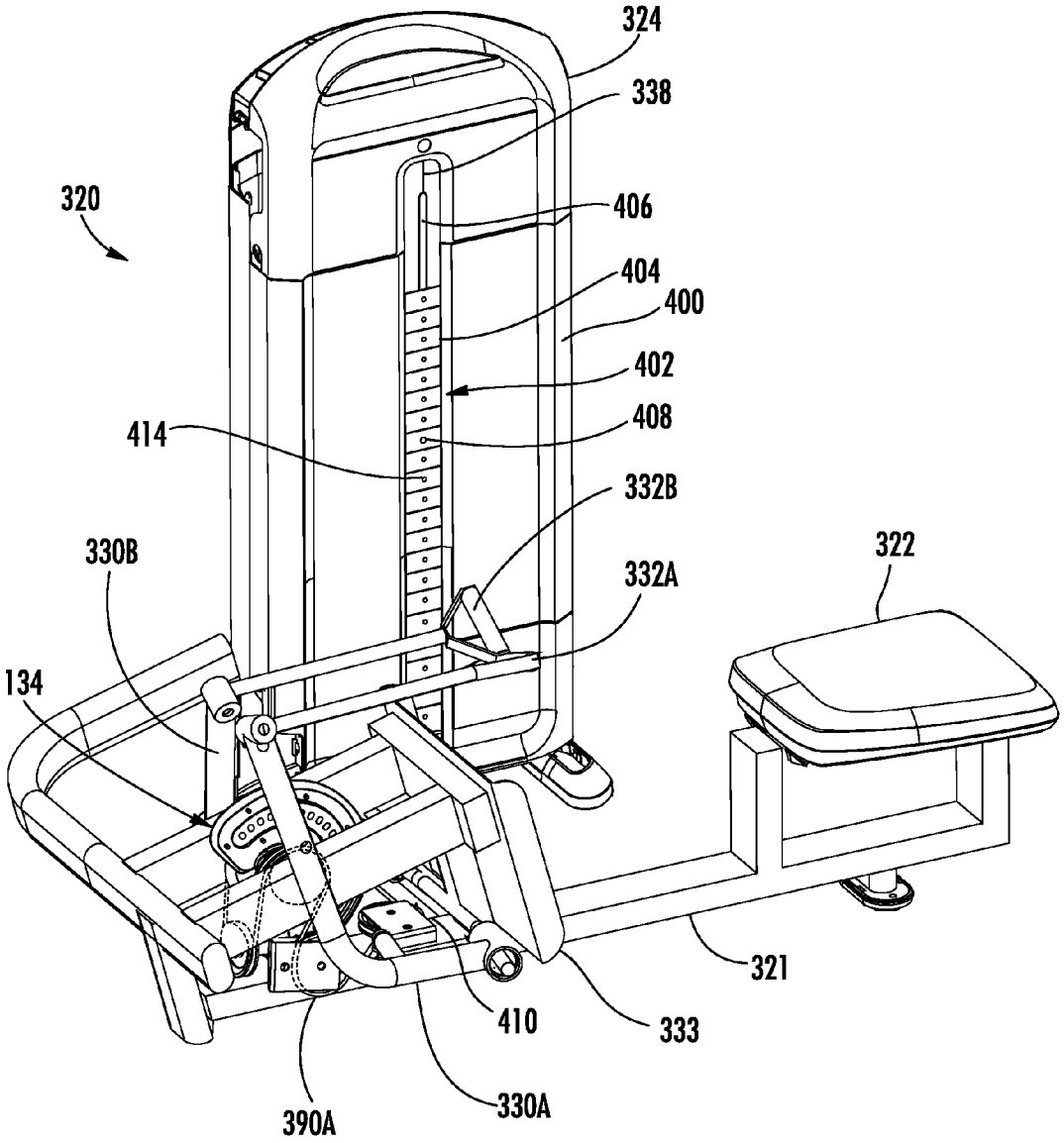
FIG. 6 is a perspective view of another example of the fitness equipment unit of FIG. 1.
Figure 7:
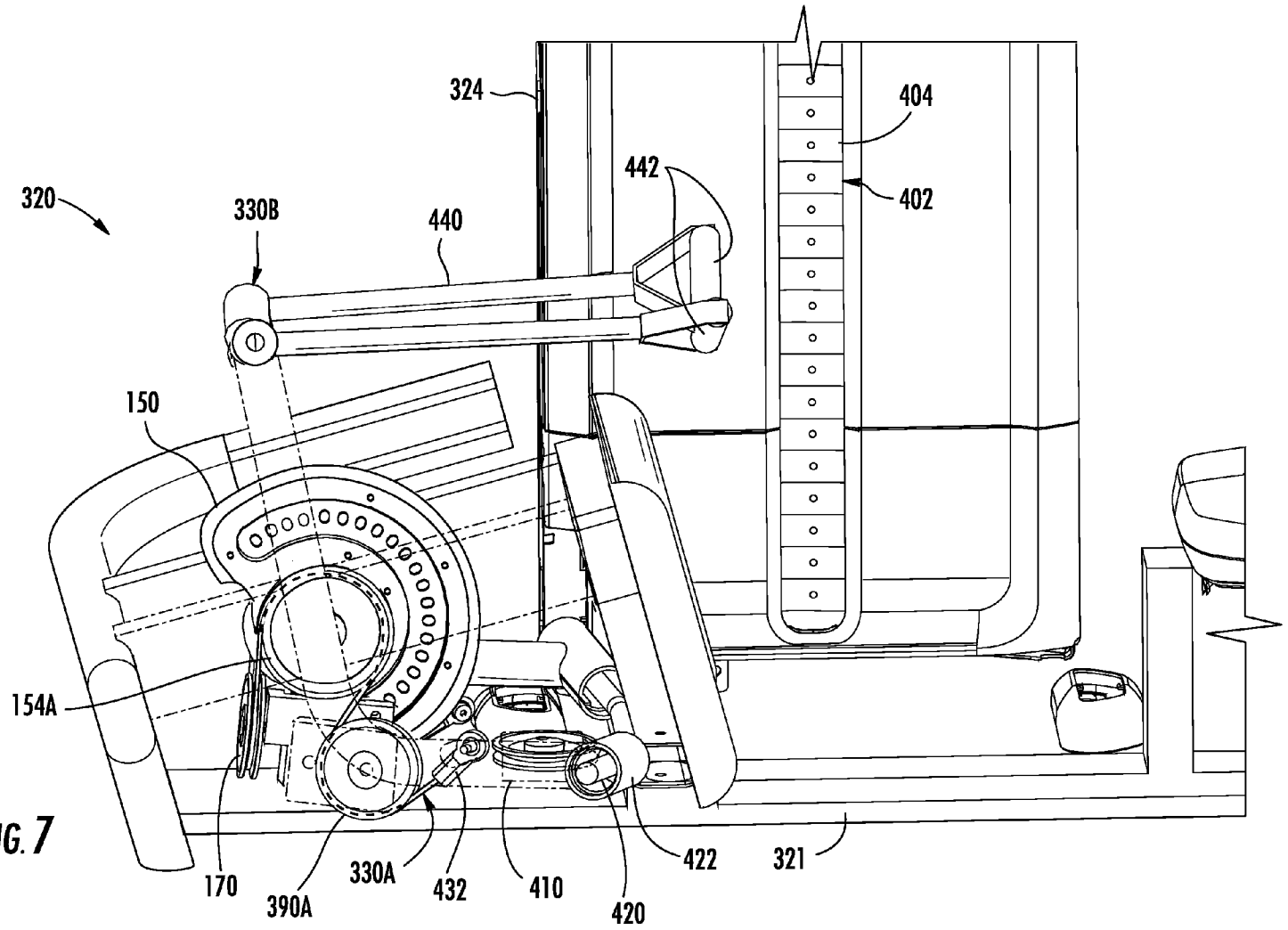
FIG. 7 is a side perspective view of the fitness equipment unit of FIG. 6 with portions shown as transparent for purposes of illustration.
Figure 8:
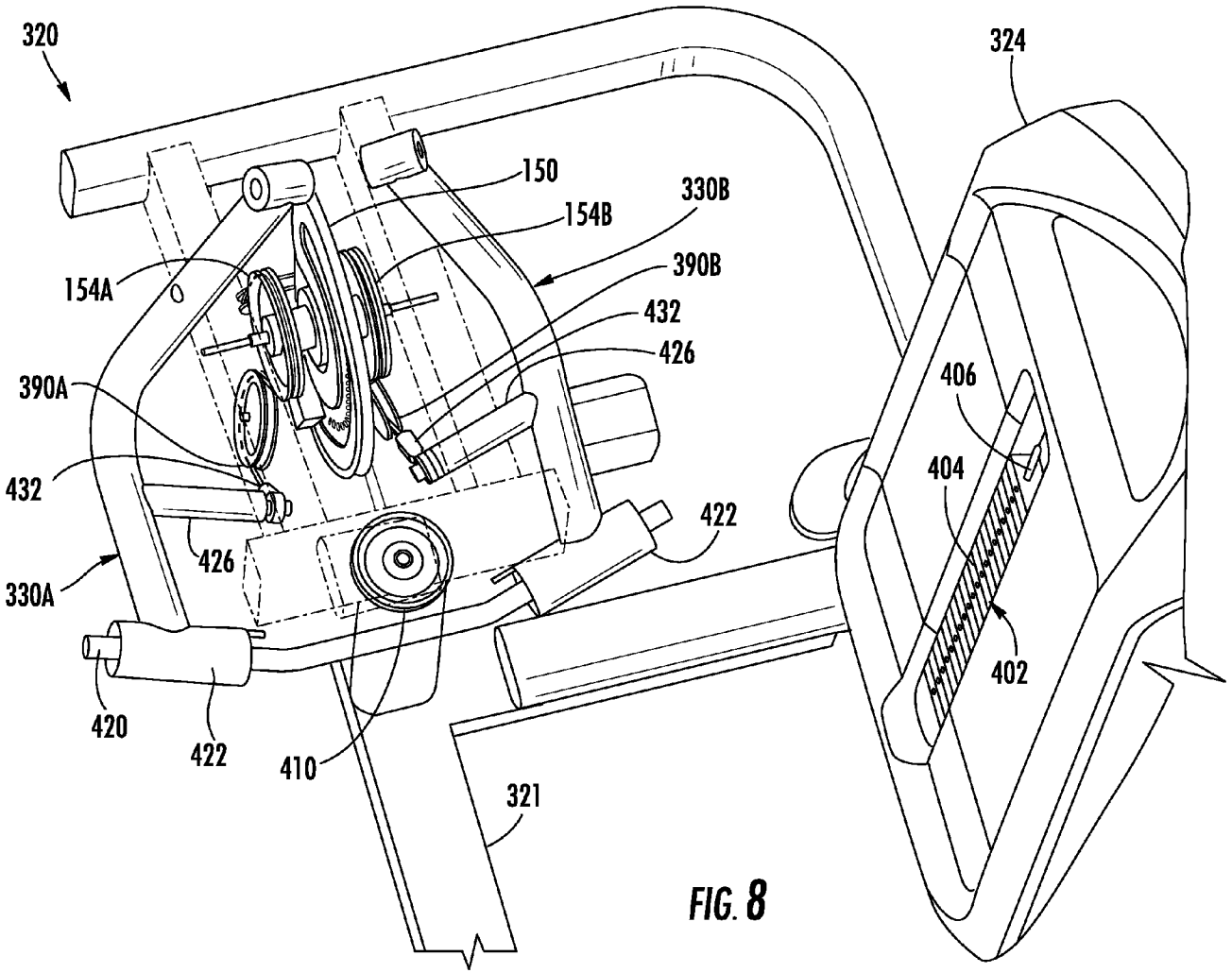
FIG. 8 is a rear perspective view of the fitness equipment unit of FIG. 6 with some portions omitted and some portions shown as transparent for purposes of illustration.

As shown by FIGS. 6 and 7, grips 332 comprise straps 440 having a first end pivotably connected to arms 330 and a second end terminating at handles 442. Handles 442 are to be manually gripped and pulled upon to rotate arms 330 about their respective axes as defined by pivot rod 420. Rotation of arms 330 results in line 180 of rotary load splitting mechanism 134 being pulled.

Rotary load splitting mechanism 134 is described above with respect to fitness equipment unit 220 of FIGS. 4 and 5. Side guides 390 guide movement of line 180 between side guides 154 and line connectors 432 coupled to arms 330. In the example illustrated, guides 390 comprise pulleys rotationally supported by frame 321 below and between guides 154 and line connectors 432. In other implementations, guides 390 comprise tooth sprockets or comprise a stationary line guiding channels, grooves or the like. In other implementations, guides 390 may be omitted.

Figure 12:
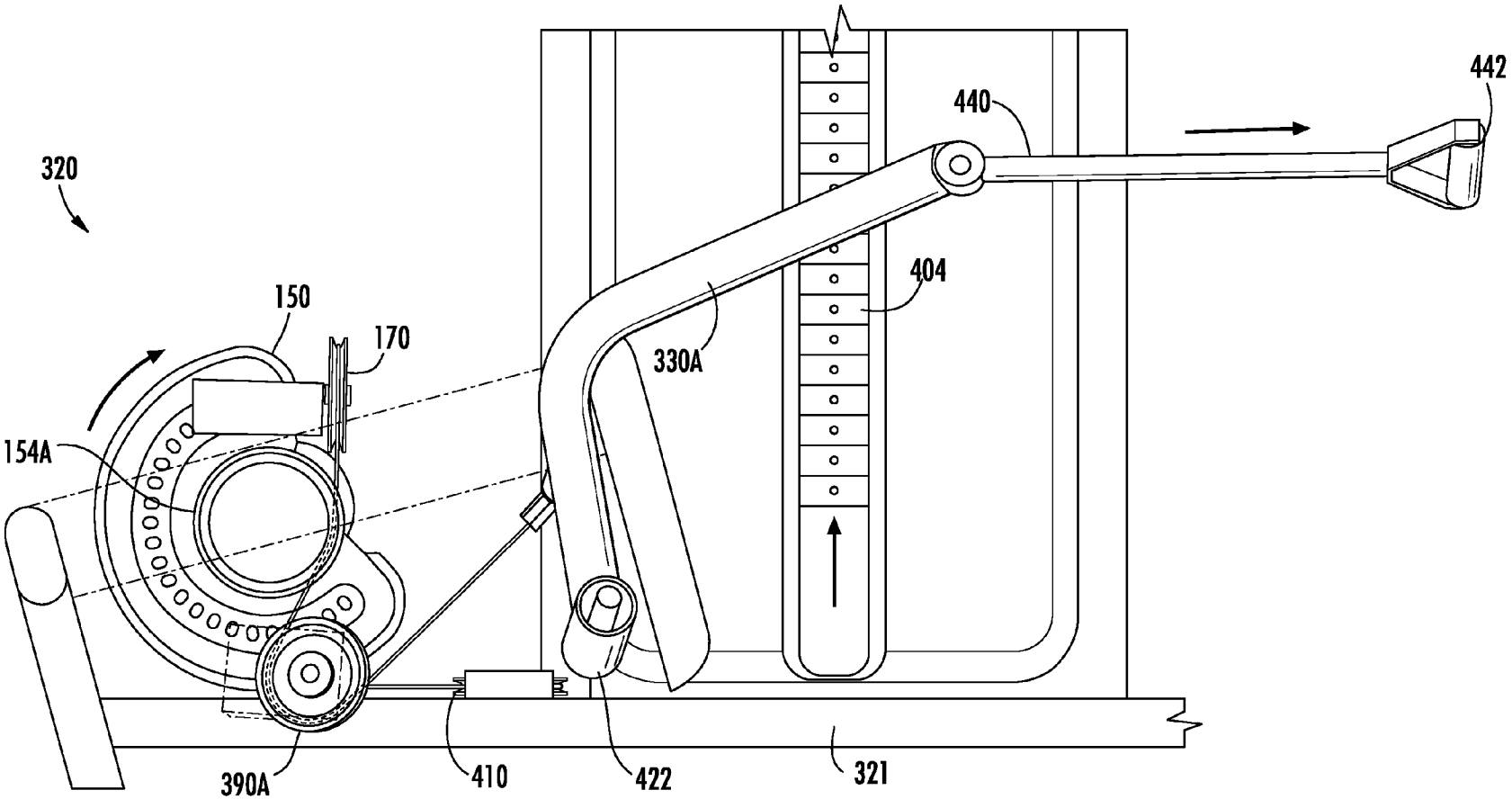
FIG. 12 is a side perspective view of the fitness equipment unit of FIG. 6 with some portions shown as transparent.
Figure 13:
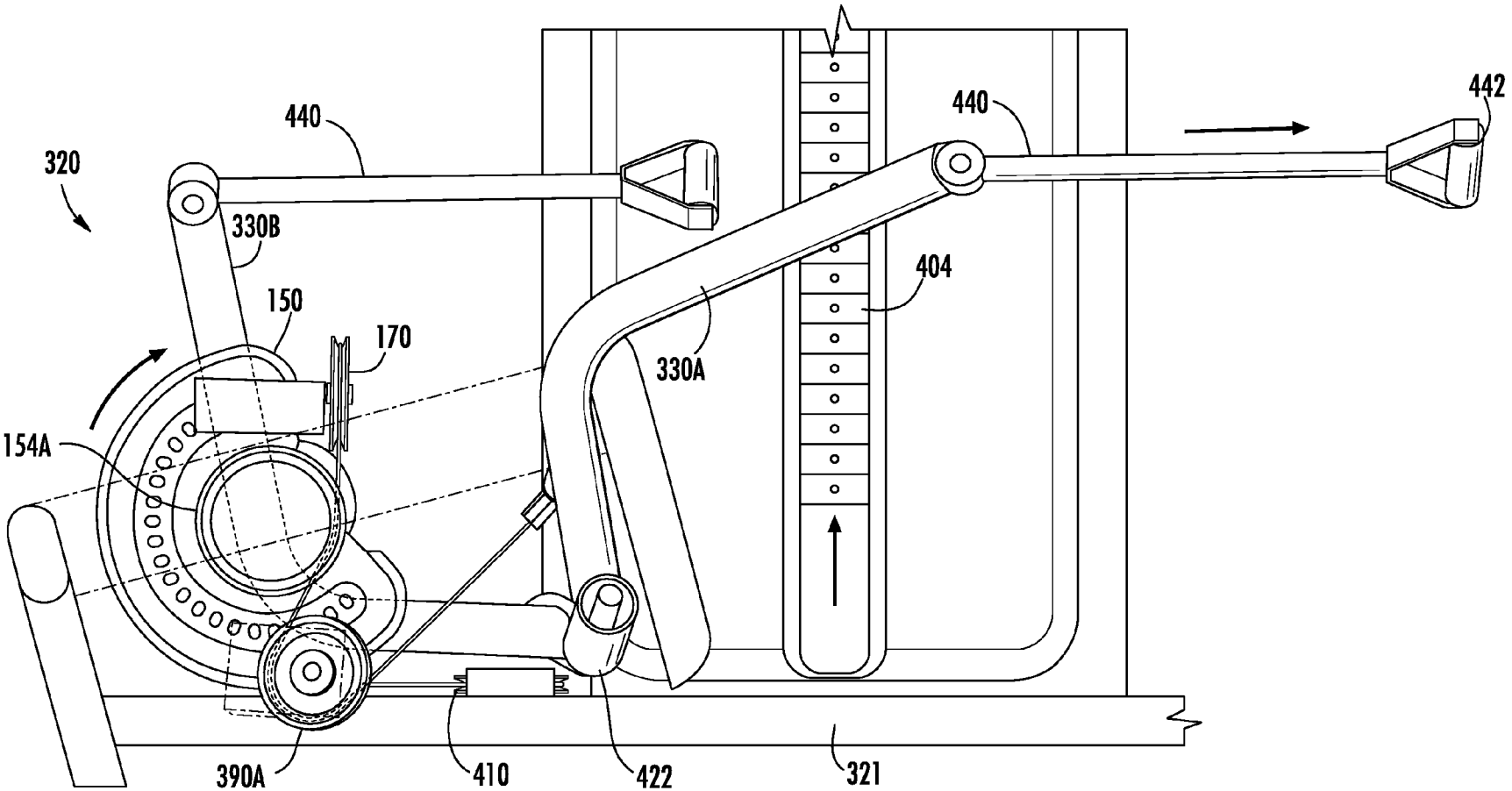
FIG. 13 is a side perspective view of the fitness equipment unit of FIG. 6 with some portions shown as transparent.

In the example illustrated, as shown by FIGS. 7-11, line 180 extends from line connector 432 associated with arm 330A, about an underside of side guide 390A, about a topside of side guide 154A, about an underside of guide 370, back up about a topside of side guide 154B, downward and about an underside of guide 390B and terminating at the line connector 432 associated with arm 330B. In operation, rotating member 150, guides 154, guides 190, guide 170 and line 180 cooperate to operably couple arms 330 to resistance source 324 such that arms 330 may be independently or concurrently moved against the forces of resistance source 324. As shown by FIG. 12, during concurrent and equal movement of arms 330, line 180 pulls on guide 370 to rotate rotatable member 150 about axis 151 in a clockwise direction as seen in FIG. 7 against the resistance offered by resistance source 324. As shown by FIG. 13, during unequal movement of arms 330, such as where one of arms 330 is moved a greater distance as compared to the other of arms 330 or such as where one arm 330 is stationary while the other of arms 330 is moved, line 180 moves across or about guide 170 as rotatable member 150 is rotated against any resistance offered by resistance source 324. During rotation of rotatable member 150, line 338 is wrapped about rotatable member 150; line 338 being contained within the channel or groove 153 (shown in FIG. 11) formed on the arcuate side of rotating member 150 (shown as a crescent-shaped pulley).

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A fitness equipment unit comprising:
- a member rotatable about an axis;
- a source of resistance against rotation of the member about the axis;
- a first arm;
- a second arm movable independent of the first arm;
- a guide carried by the member to rotate about the axis; and
- a single line having a first portion connected to the first arm and a second portion connected to the second arm, wherein the single line extends about the guide such that movement of the first arm with the second arm being stationary, movement of the second arm with the first arm being stationary or movement of both the first arm and the second arm rotates the member about the axis against the source of resistance.

2. The fitness equipment unit of claim 1, wherein the guide comprises a pulley.

3. The fitness equipment unit of claim 2 further comprising a second pulley on a first side of the member and a third pulley on a second side of the member, wherein the single line extends about the second pulley, about the pulley and about the third pulley.

4. The fitness equipment unit of claim 3, wherein the second pulley and the third pulley are rotatable about the axis.

5. The fitness equipment unit of claim 3, wherein the member comprises a fourth pulley and further comprising a second line operably coupling the fourth pulley to the source of resistance.

6. The fitness equipment unit of claim 5, wherein the pulley is between the second pulley and the third pulley and in front of the fourth pulley.

7. The fitness equipment unit of claim 3, wherein the single line extends over the axis while engaging the second pulley and the third pulley and wherein the single line extends below the axis when extending from the member such that the pulley rotates about the axis in a direction over the axis in response to movement of the first arm, the second arm or both the first arm and the second arm.

8. The fitness equipment unit of claim 3, wherein the pulley is between the second pulley and the third pulley and in front of the member.

9. The fitness equipment unit of claim 1, wherein the member comprises a pulley and wherein the fitness equipment unit further comprises a second line operably coupling the pulley to the source of resistance.

10. The fitness equipment unit of claim 1, wherein the member is crescent shaped.

11. The fitness equipment unit of claim 1 further comprising a second line having a first end connected to the member and a second end connected to the source of resistance.

12. The fitness equipment unit of claim 11, wherein the second line wraps at least partially about the member during rotation of the member.

13. The fitness equipment unit of claim 1, wherein the source of resistance comprises a stack of weights.

14. The fitness equipment unit of claim 1, wherein the first arm and the second arm are independently pivotable.

15. The fitness equipment unit of claim 14, wherein the first arm and the second arm are independently pivotable about a horizontal axis.

16. A fitness equipment unit comprising:
- a stack of weights;
- a first arm;
- a second arm movable independent of the first arm;
- a first pulley rotatable about an axis;
- a second pulley carried by the first pulley to rotate about the axis;
- a third pulley on a first side of the first pulley;
- a fourth pulley on a second side of the first pulley;
- a first line having a first end portion connected to the first pulley and a second end portion operably coupled to the stack of weights; and
- a second single line having a first portion connected to the first arm and a second portion connected to the second arm, wherein the second single line extends about the third pulley, about the second pulley and about the fourth pulley such that movement of the first arm being stationary, movement of the second arm with the first arm being stationary or movement of both the first arm and the second arm rotates the member about the axis to pull the first line.

17. The fitness equipment unit of claim 16, wherein the third pulley and the fourth pulley are rotatable about the axis.

18. The fitness equipment unit of claim 16, wherein the second pulley is between the third pulley and the fourth pulley and in front of the first pulley.

19. The fitness equipment unit of claim 16, wherein the second single line extends over the axis while engaging the third pulley and the fourth pulley and wherein the first line extends below the axis when extending from the first pulley such that the second pulley rotates about the axis in a direction over the axis in response to movement of the first arm, the second arm or both the first arm and the second arm.

20. The fitness equipment unit of claim 13, wherein the first arm and the second arm are independently pivotable.

21. The fitness equipment unit of claim 1, wherein the member comprises a first pulley, the fitness equipment unit further comprising a second pulley on a first side of the member and a third pulley on a second side of the member, wherein the single line extends about the second pulley, about the first pulley and about the third pulley and wherein the first pulley, the second pulley and the third pulley are parallel.

22. The fitness equipment unit of claim 3, wherein the third pulley is rotatable about a second axis nonparallel to a third axis about which the line turns about the guide.

23. The fitness equipment unit of claim 16, wherein the third pulley and the fourth pulley rotate about a second axis that is parallel to a third axis about which the second pulley is rotatable.

24. A fitness equipment unit comprising:

a member rotatable about an axis;

a source of resistance against rotation of the member about the axis;

a first arm;

a second arm movable independent of the first arm;

a guide carried by the member, wherein the guide comprises a first pulley; and a line having a first portion connected to the first arm and a second portion connected to the second arm, wherein the line extends about the guide such that movement of the first arm with the second arm being stationary, movement of the second arm with the first arm being stationary or movement of both the first arm and the second arm rotates the member about the axis against the source of resistance; and a second pulley on a first side of the member and a third pulley on a second side of the member, wherein the line extends about the second pulley, about the first pulley and about the third pulley, wherein the line extends over the axis while engaging the second pulley and the third pulley and wherein the line extends below the axis when extending from the member such that the first pulley rotates about the axis in a direction over the axis in response to movement of the first arm, the second arm or both the first arm and the second arm.

* * * * *